US005409162A

United States Patent [19]

Sickles

[11] Patent Number: 5,409,162

[45] Date of Patent: Apr. 25, 1995

[54] INDUCTION SPRAY CHARGING APPARATUS

[76] Inventor: James E. Sickles, 21889 Potomac Dr., Southfield, Mich. 48076

[21] Appl. No.: 103,212

[22] Filed: Aug. 9, 1993

[51] Int. Cl.[6] ..... B05B 5/043

[52] U.S. Cl. ..... 239/3; 239/690.1; 239/698; 239/705; 239/707; 239/296; 239/300; 239/416.5; 239/522

[58] Field of Search ..... 239/3, 690, 690.1, 697, 239/698, 699, 700, 702, 703, 704, 705, 706, 707, 708, 290, 296, 300, 301, 416.5, 417, 522, 523

[56] References Cited

U.S. PATENT DOCUMENTS

| | | | |
|---|---|---|---|
| 2,766,064 | 10/1956 | Schweitzer | 239/699 |
| 3,093,309 | 6/1963 | Watanabe . | |
| 3,408,985 | 11/1968 | Sedlacsik, Jr. . | |
| 3,425,625 | 2/1969 | Probst . | |
| 3,677,470 | 7/1972 | Probst et al. | 239/707 |
| 3,737,090 | 6/1973 | Shaffer . | |
| 3,767,115 | 10/1973 | Kozinski et al. . | |
| 4,002,777 | 1/1977 | Juvinall et al. | 239/3 X |
| 4,009,829 | 3/1977 | Sickles | 239/690.1 |
| 4,073,002 | 2/1978 | Sickles et al. | 239/690.1 X |
| 4,106,697 | 8/1978 | Sickles et al. . | |
| 4,120,017 | 10/1978 | Sickles . . | |
| 4,186,886 | 2/1980 | Sickles | 239/690.1 |
| 4,232,824 | 11/1980 | Binoche . | |
| 4,266,721 | 5/1981 | Sickles | 239/3 |
| 4,313,968 | 2/1982 | Sickles . | |
| 4,341,347 | 7/1982 | DeVittorio . | |
| 4,343,433 | 8/1982 | Sickles | 239/3 |
| 4,347,984 | 9/1982 | Sickles | 239/690.1 |
| 4,377,603 | 2/1983 | Itoh et al. . | |
| 4,440,349 | 4/1984 | Sickles et al. . | |
| 4,721,255 | 1/1988 | Lind | 239/690 |
| 4,761,299 | 8/1988 | Hufstetler et al. . | |
| 4,779,564 | 10/1988 | Kiefer et al. . | |
| 4,842,203 | 6/1989 | Kuhn et al. | 239/708 X |
| 4,911,367 | 3/1990 | Lasley | 239/707 X |
| 5,044,564 | 9/1991 | Sickles | 239/690.1 |
| 5,090,619 | 2/1992 | Barthold et al. | 239/417 X |
| 5,090,623 | 2/1992 | Burns et al. . | |
| 5,178,330 | 1/1993 | Rodgers . | |
| 5,188,290 | 2/1993 | Gebauer et al. . | |
| 5,222,663 | 6/1993 | Noakes et al. | 239/690 X |

FOREIGN PATENT DOCUMENTS

| | | | |
|---|---|---|---|
| 1125358 | 6/1982 | Canada | 239/690.1 |

OTHER PUBLICATIONS

Aneston et al., "Charge To Mass Distributions in Electrostatic Sprays", IEEE Transaction on Industry Applications, vol. IA-13, No. 2, Mar./Apr. '77.

McCarthy et al., "Specific Charge Measurements in Electrostatic Air Sprays", presented at 1993 Electrostatic Soc. of American Meeting, Canada.

Balachandran et al., "Electrostatic Atomization of Conducting Liquids Using AC Superimposed on DC Fields", 1992 IEEE-IAS Annual Conf., Texas.

*Primary Examiner*—William Grant

*Attorney, Agent, or Firm*—Jones, Tullar & Cooper

[57] ABSTRACT

Induction charging apparatus for HVLP spray guns includes an air cap having a central fluid exit orifice for receiving the spray gun nozzle. The cap includes one or more charging electrodes surrounding the orifice and carrying a voltage sufficiently large to induce on the spray droplets charges of a polarity opposite to that on the electrodes. The cap includes a rotatable electrical connector to enable the cap to rotate 360°, while maintaining electrical connections between the electrodes and a power supply.

42 Claims, 8 Drawing Sheets

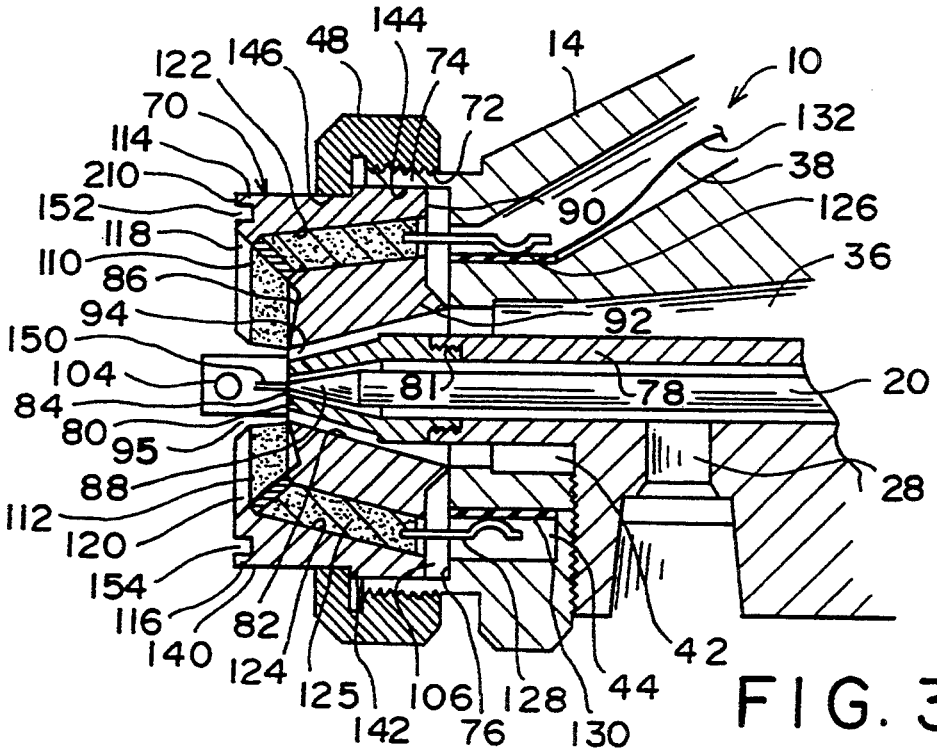
FIG. 3
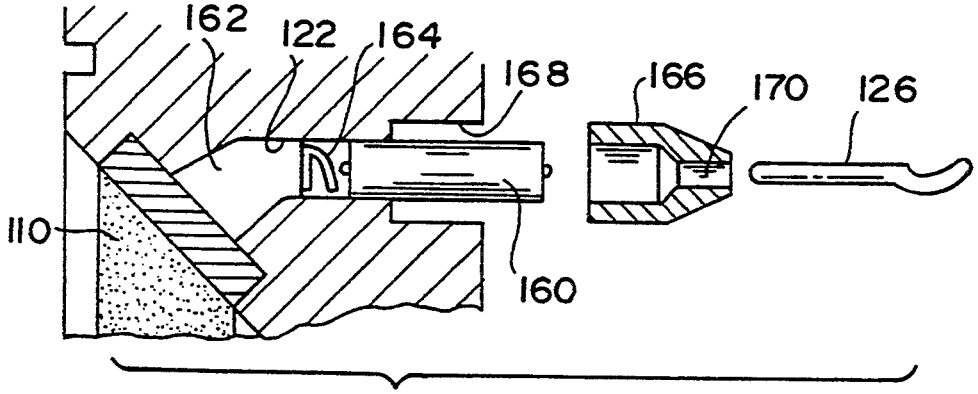
FIG. 4
FIG. 6
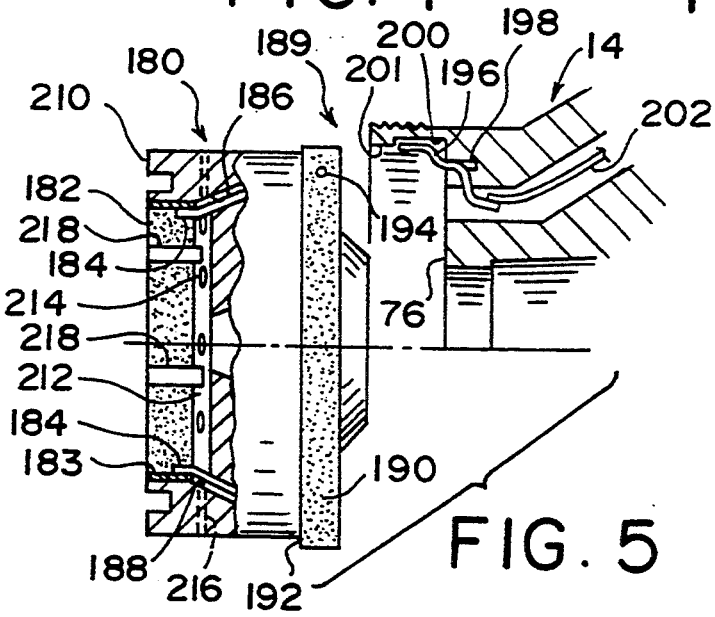
FIG. 5
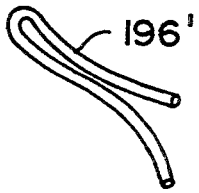
FIG. 7
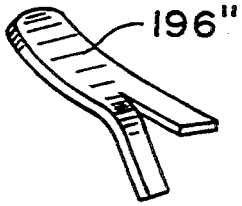

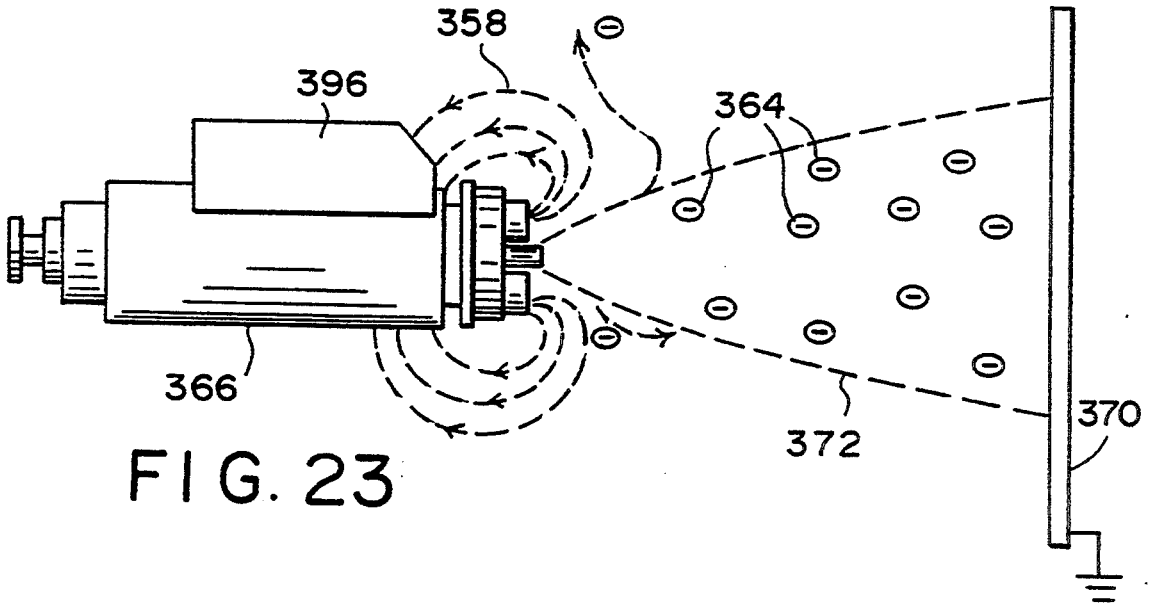
FIG. 23
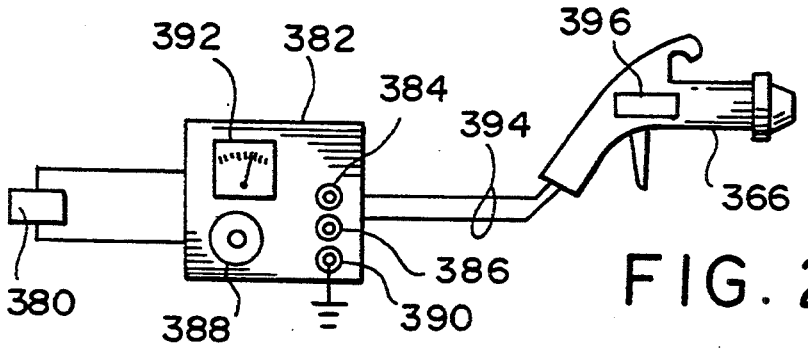
FIG. 24
FIG. 25
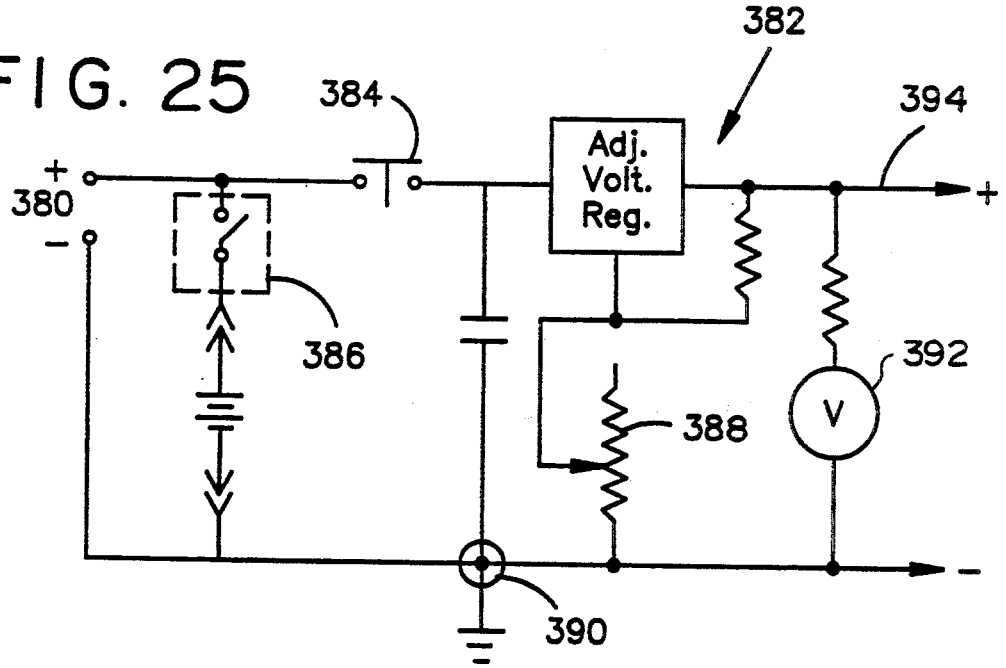

INDUCTION SPRAY CHARGING APPARATUS

BACKGROUND OF THE INVENTION

The present invention relates, in general, to an improved spray gun for producing charged fluid particle sprays, and more particularly to induction charging apparatus for a high volume, low pressure fluid spray device and to a method for inducing charges on conductive atomized fluids.

This invention is related to that disclosed in U.S. Pat. No. 5,044,564 issued to James E. Sickles on Sep. 3, 1991, the disclosure of which is incorporated herein by reference.

Conventional airless, air assisted, or air atomization spray guns incorporate a spray cap having a spray nozzle, the nozzle portion of the cap including liquid passageways and some mechanism for atomizing a liquid such as paint. In such devices, the liquid flows under pressure or is siphoned through a central passageway in the cap for discharge through a central outlet orifice. This liquid flow is typically controlled by a flow control needle valve located in the central passageway, and the size of the orifice and the pressure of the operator's hand on the spray gun trigger is selected so that the liquid is atomized as it is discharged. In an air assisted or air atomized spray gun, air outlets are provided near the central liquid orifice to assist in the atomization and to control the direction and flow pattern of the resulting liquid particles or droplets. Thus, air under pressure may be supplied coaxially with the liquid ejected from the liquid outlet orifice to further atomize the liquid and to impel the droplets outwardly away from the spray gun nozzle. This air flow typically is through a single annular orifice surrounding the liquid outlet, although additional air outlet orifices may be provided at locations spaced outwardly from the liquid outlet. In addition, air may be supplied by a pair of forwardly projecting air horns mounted on the spray cap, the air horns incorporating additional air outlets directed generally inwardly toward the axis of the atomized spray to control its pattern. Typically, these air horns shape the atomized spray into a fan pattern to facilitate operation of the spray gun, with the air cap being positioned on the spray gun to provide, for example, a vertical fan or a horizontal fan pattern.

The use of such conventional spray guns for spraying materials such as paint having a high solids content creates problems, since such spray guns have low transfer efficiencies, in the range of 15 to 30% for an air-atomized paint spray. Increased efficiency has been obtained through electrostatic charging of the atomized coating material, such charging increasing the efficiency to the range of 45 to 75% for electrostatic air atomized spray devices and from 90 to 99% for electrostatic rotary bell spray devices. However, even electrostatic devices present problems, particularly when spraying a conductive liquid such as water-based paint, for it is necessary to electrically isolate such a system to prevent high voltages from endangering users or causing electrical discharges which could result in fires or explosions. Various techniques have been provided for producing the necessary isolation, but difficulties have been encountered in each such system.

Most prior electrostatic air spray or air-assisted spray devices have in common a spray gun to which is mounted a high voltage electrode disposed adjacent the spray discharge point or more commonly, in direct contact with the liquid stream itself, and carrying an electrical potential in the neighborhood of 50 to 85 KV, and in some instances as high as 150 KV. Such a device is illustrated, for example, in U.S. Pat. No. 4,761,299, where a voltage on the order of 100 KV is applied between the spray gun electrode and the article being sprayed. In addition to providing high voltage contact (or conduction) charging of the spray droplets by direct physical contact of the liquid with the electrodes, the electric field produced by this voltage creates a field rich in gaseous ions through which the spray particles must pass so that some of the ions become attached to the particles. This produces electric charges on the particles of the same polarity as that of the high voltage electrode, causing them, together with copious quantities of free, unattached ions, to migrate toward the grounded workpiece. It has been found that the free ion current deposited on a grounded target can be up to several times that deposited by charged spray particles.

Such electrostatic, or corona effect, devices encounter numerous difficulties, not only because of the very high voltages required to produce effective operation, but because a significant part of the current between the spray gun and the target, or workpiece, is due to free ions, rather than charged particles, thereby reducing transfer efficiency. The high voltages are a problem because they require large, heavy and relatively expensive power supplies and because the cable interconnecting the power supply and the spray gun charging electrode necessarily has to be heavily insulated, making it bulky, relatively inflexible, and expensive. The size and weight of the power supply and its cable substantially restricts the usefulness of conventional corona effect spray guns.

Various attempts have been made to overcome the power supply problem of such high voltage devices, but with limited success. The use of high voltages, furthermore, is hazardous not only because of the possibility of creating electrical arcing when the gun is moved near grounded objects, but because of the danger to the operator if the electrode is inadvertently touched. Furthermore, the high voltages used in such systems create a current flow of excess ions travelling to nearby objects, in addition to the target, resulting in an undesired charge build-up on such nearby objects if they are not adequately grounded. The hazard of sparking and consequent fire exists when the operator or some other grounded object is brought close to such a charged object. Further, the migration of such charges causes an undesired build-up of the charged spray particles on objects other than the workpiece.

SUMMARY OF THE INVENTION

An effective way to overcome the difficulties of high voltage electrostatic devices is through the use of induction charging apparatus. This eliminates the need for the very high voltages used in corona discharge by causing an atomized spray to be formed in the presence of a static electric field which has an average potential gradient in the range of about 5 to 30 KV per inch. In such devices, the spacing between the liquid and the source of potential is made sufficient to prevent an electrical discharge so that a capacitive effect produces the required static field. This field induces on liquid particles produced within the field electric charges having a polarity which is opposite to that of the applied voltage. The resulting charged particles can then be directed, for example, toward an electrically grounded work piece to provide a coating of the liquid on the work piece. Such induction charging techniques have been found to be particularly useful in spray systems utilizing electrically conductive liquids such as water based paints, since the liquid supply can be electrically grounded, as opposed to the high voltage devices noted above, wherein the liquid is at the high voltage of the discharge electrode. It has been found that such induction charging apparatus is capable of coating a nonconductive work piece with a conductive paint, while achieving good "wrap around" and a smooth, even surface.

The present invention relates to an improved induction charging apparatus for automatic or hand held spray guns. The induction charging apparatus includes an air cap which is preferably used with high volume, low pressure (HVLP) spray guns, such as those described in U.S. Pat. No. 4,915,303 to Hufgard, issued Apr. 10, 1990, wherein an HVLP spray gun is defined as producing a high volume of air, in the range of about 5–60 cubic feet per minute at a pressure of less than about 10 psig. The air cap has a central fluid exit orifice which receives a spray gun liquid spray nozzle, with an axial flow control needle being movable in the central orifice of the nozzle to regulate the flow of the liquid to be charged and sprayed. The air cap carries curved electrodes which are mounted on the front of the cap and extend forwardly of the liquid spray outlet orifice, the electrodes being generally concentric with the flow control needle and the central fluid orifice. The cap also includes air passageways to supply high volumes of air at low pressure to corresponding air exit openings, or orifices, located around the liquid outlet.

The curved electrodes preferably extend generally circumferentially around at least part of the forward face of the air cap, and are located on the inner surface of a forwardly extending electrode support portion to produce an electric field in front of the liquid exit orifice. This induction field produces in atomized liquid particles ejected from the spray gun orifice charges having a polarity opposite to the polarity of the voltage supplied to the electrodes. The air cap includes connectors for the curved electrodes to allow connection of these electrodes to a suitable power supply carried by or connected to the spray gun.

The electrodes can be formed as a conductive or semiconductive layer on the inner surface of the electrode support portion of the air cap, with the layer being coated onto the support surface. Alternatively, the electrode can be a separate element or elements secured to the electrode support as by adhesive or other fasteners can be molded into plastic support elements which are then secured to the face of the air cap, or can be molded into the air cap itself when the air cap is fabricated from molded plastic material. The inner surface of the electrode support can be cylindrical or conical, and the electrode can be single piece surrounding the liquid orifice and coaxial therewith, or can be segmented into multiple pieces. In a preferred form, the electrode support consists of a pair of diametrically opposed generally semicircular segments.

To control the pattern of the spray droplets discharged from the nozzle through the electric field produced by the electrodes, one or more air horns are provided around the periphery of the cap. In the preferred form of the invention, two diametrically opposed air horns, each including air outlet apertures which direct a flow of air inwardly against the spray droplets, are provided, the air horns being located between electrode segments. The air horns are spaced from adjacent electrode segments to provide flow paths to permit ambient air around the exterior of the air cap to flow into the interior of the electrode supports and into the droplet flow path.

If desired, one or more additional air paths may be provided in the air cap, leading from the inner surface of the electrode support (or supports) to the exterior of the air cap to allow aspiration of ambient air into the droplet flow path.

The air cap preferably is secured to a conventional hand held or automatic spray gun by means of a standard internally threaded retainer ring which engages external threads on the gun. The air cap is rotatable 360° in a plane perpendicular to the axis of the fluid exit orifice and can be fixed at any desired rotational angle by tightening the retainer. Air flow passageways within the spray gun are formed with annular chambers and/or closely spaced parallel passageways at the front face of the gun which cooperate with corresponding passageways in the cap at any angular position of the cap so as to allow 360° adjustment of the location of the electrodes and air horns. Connectors are provided by which the semicircular electrodes on the cap are connected to a power supply in the gun, the connector being rotatable so that connection is made at any rotational angle of the cap. Such connectors preferably include an annular contact surface on one of the relatively movable cap and spray gun and further include at least one wiper, preferably in the form of a spring contact, on the other of the relatively movable parts, whereby contact is maintained at any angle.

The flow control needle in the liquid nozzle is movable axially within the central liquid exit orifice when the cap is mounted on the spray gun, the needle serving as a valve to regulate the rate of flow of the liquid being sprayed into the cap flow passage. In some embodiments it may be desirable to provide a thin needle extension which extend through the exit liquid orifice a short distance; for example, so that it extends about ¼ inch beyond the face of the air cap, to provide a corona discharge point or to enhance the induction charging of atomized liquid particles. In another embodiment of the invention, the needle may be slightly curved or spade-shaped to form a paddle, and mounted on a rotary shaft for rotation in the path of exiting liquid particles, or droplets, to assist in atomization and charging of the fluid droplets.

In still another embodiment of the .invention, the liquid flow control needle may be hollow so that air under pressure may flow through it and exit from it just forward of the liquid exit orifice to thereby distribute atomized droplets for improved charge acquisition. A deflector may be incorporated at the outlet end of the hollow needle for improved distribution of the droplets. A similar effect can be obtained by vibrating the needle laterally within the liquid flow passageway.

The present invention is particularly useful in a high volume, low pressure air flow spray gun such as the gun described in U.S. Pat. No. 5,178,330, issued Jan. 12, 1993, to Michael C. Rogers. Such HVLP spray guns are defined as those having exit air pressures at or below 10 psig, and this patent describes in some detail how HVLP atomization of liquids can be attained. Although such HVLP spray guns have numerous advantages, notably significantly enhanced application efficiency, in some cases HVLP devices have difficulty producing the fine liquid atomization of high pressure systems. As a result, HVLP devices have, in the past, experienced lower average droplet charge-to-mass ratios than are attained with high pressure systems. In addition, low pressure systems often allow lower attractive forces to deflect charged droplets back to the spray gun. However, because of the advantages of such devices they can, in the combination of the present invention, provide significant advances over other systems. In particular, the present invention combines a low induction voltage, in the range of 5–10 KV, with the HVLP system, with the spray gun and the axial flow control needle valve being electrically grounded so that the spray gun is safe for an operator to handle. The induction voltage is applied only to the semicircular electrodes surrounding the liquid orifice, this voltage serving to produce the main electric field in the droplet flow path between the electrodes and the flow control needle. The electric field also extends between the electrodes and the spray gun exteriorly of the air cap. The voltage in the range of about 5–10 KV utilized in the present invention is in contrast to the voltages in the range of 80 to 150 KV used by prior electrostatic spray guns. A resistor is connected between the electrode power supply and the electrode itself to prevent excessive current flow in the event one of the electrodes becomes short circuited. In the normal operating mode of the device of the present invention, low pressure air flowing from the air exit orifice (or orifices) surrounding the central liquid exit is adjusted to have a volume and flow rate which breaks the liquid exiting from the central orifice into tiny droplets. This atomization of the liquid occurs in the electric field produced by the electrodes so that during formation of the droplets charges are induced in them. These charges are not produced by ionization mechanisms, but instead are induced by the field during the formation of the droplets, and the induced charges produce a spray which has a net electrical polarity on each droplet opposite to that of the voltage applied to the electrodes. Thus, if the voltage applied to the electrodes is positive with respect to the neutral ground potential of the needle, the charge induced on the fluid droplets will be negative. Similarly, if the charge applied to the electrodes is negative with respect to ground, the induced charge will be positive. Although this is the normal and preferred mode of operation of the present device, it is noted that it may at times be desirable, as when a low conductivity liquid is to be sprayed, to increase the voltage somewhat, to about 12 KV or even more, for example, and to utilize a needle extension from the control valve needle into the flow path. This facilitates a corona discharge which will further add to the charging of the liquid.

The electric field produced by the electrodes is confined to the spray gun head, with the target being grounded so that under normal operating conditions no particle depositing potential gradient or electric field exists between the spray gun and the target. Because no depositing field is required, the device of the present invention substantially reduces the likelihood of arcing and provides a significant safety factor to the operator. Instead of relying on a high voltage to cause particles to travel to a target, the invention produces a "cloud" of charged particles which are directed toward the target by air flow. When the particles reach the target, they form a thin, even coating thereon. Thus, the airflow directs the cloud of charged particles to a target without the need for a high potential between the gun and the target and without adding free ions to the spray cloud.

Although the present invention is described in terms of an air-assisted spray gun, it will be understood that gases other than air can be used, if desired. Accordingly, where the term air is used hereinafter, it will be understood to include gases. Furthermore, although the invention is particularly advantageous in HVLP spray guns, it will be understood that the air cap and its charging electrode arrangement can also be used to advantage with conventional air atomization or mixed air/airless spray guns.

BRIEF DESCRIPTION OF THE DRAWINGS

The foregoing and additional objects, features, and advantages of the present invention will become apparent to those of skill in the art from a consideration of the following detailed description of preferred embodiments thereof, taken into conjunction with the accompanying drawings, in which:

FIG. 3 is a cross sectional view of the air cap of FIG. 2, taken along lines 3—3 thereof, and showing one form of connector, utilizing spring wiper arms, between the rotatable cap and the air gun body;

FIG. 4 is an enlarged partial view of the air cap of FIG. 3, illustrating a modified spring wiper arm;

FIG. 5 is a partial sectional view of the air cap of FIG. 3, illustrating a second embodiment of the connector between the air cap and the spray gun body;

FIG. 6 is a perspective view of a spring wiper arm for use in the embodiment of FIG. 5;

FIG. 7 is a perspective view of a modified spring wiper arm for the embodiment of FIG. 5;

FIG. 23 is a diagrammatic illustration of the electric field and the spray pattern produced by the air cap of the present invention;

FIG. 24 illustrates a power supply control for a spray gun utilizing the air cap of the present invention;

FIG. 25 is a diagrammatic illustration of a suitable power supply for use with the air cap of the present invention.

DESCRIPTION OF PREFERRED EMBODIMENTS

Figure 1:
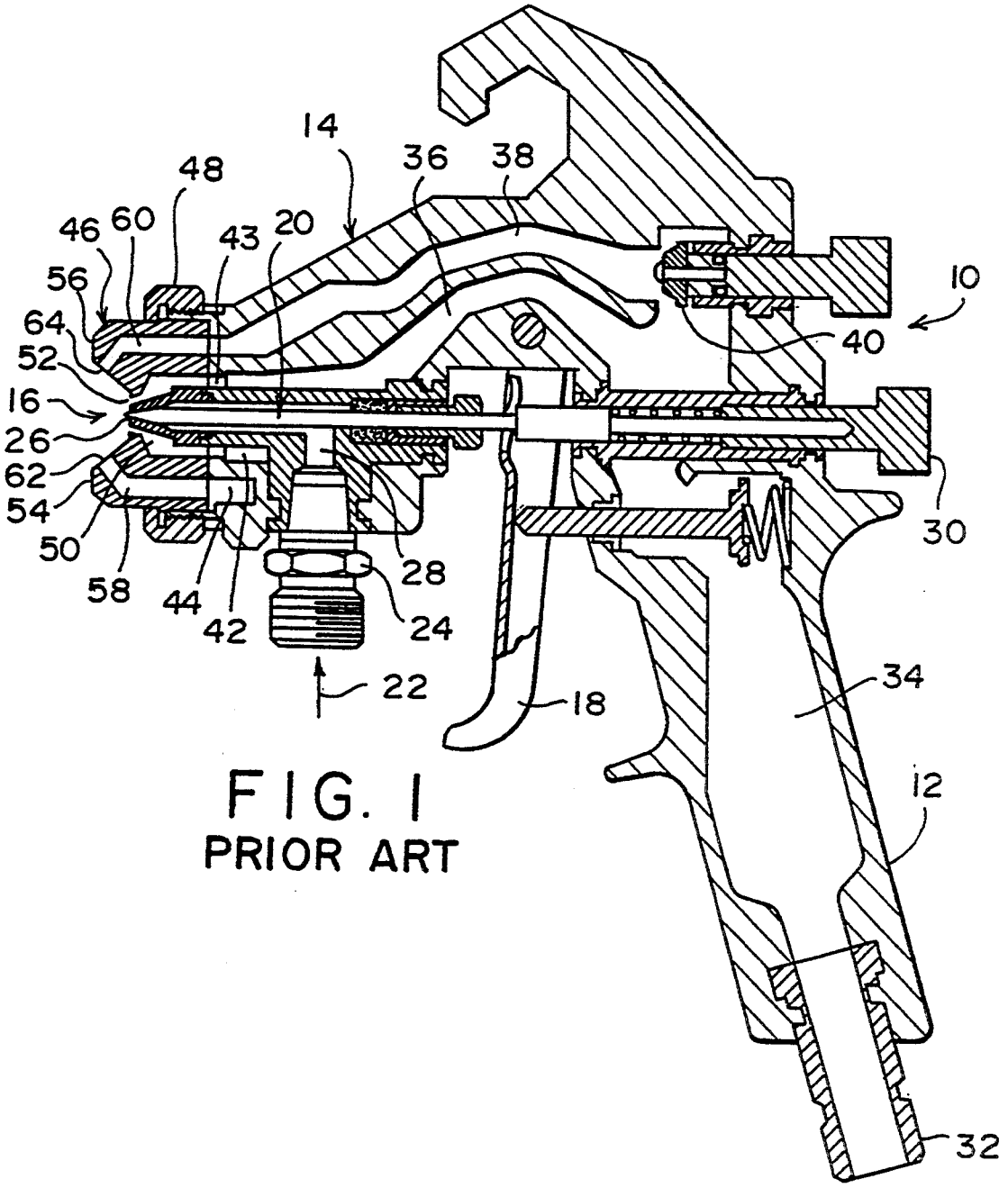
FIG. 1 PRIOR ART
FIG. 1 is a diagrammatic cross sectional view of a conventional hand held fluid spray gun.

Referring now to the drawings and in particular to FIG. 1 there is illustrated at 10 a conventional air-operated spray gun having a handle portion 12, a barrel, or body portion, 14 and a nozzle assembly generally indicated at 16. The illustrated spray gun is a hand held device having a conventional trigger 18 which operates a needle valve assembly 20 which controls the flow of a liquid to be sprayed. This liquid is supplied under pressure as indicated at arrow 22, through a suitable connector 24. The flow control needle valve 20 extends through the spray gun body 14 into the nozzle assembly 16 to regulate the flow of liquid through an exit orifice 26 at the distal end of the nozzle. The liquid to be sprayed, which in one preferred embodiment of the invention is a conductive or semiconductive paint, passes through a passageway 28 around the outside of needle valve 20 and through orifice 26, where it is discharged as an atomized spray of droplets. The location of the needle valve 20 is regulated by a threaded adjuster knob 30, in conventional manner.

A propellant or atomizing fluid such as air or another suitable gas is applied under pressure to the nozzle assembly 16 by way of an air hose connector 32 and an air passageway 34 in the handle of the spray gun. To provide the required degree of atomization and to regulate the discharge pattern of the spray, the air supply is fed to two separate passageways 36 and 38 extending through the body portion 14 of the spray gun. The air flow in passageway 36 is regulated by the pressure of the external air supply, while the air flow in passageway 38 is regulated by a manual control valve 40.

In accordance with known spray gun construction, air flow passageway 36 terminates at the forward end of the body portion 14 in an annular air chamber 42 which extends to the face of the spray gun body portion as an annular air orifice or as a plurality of circular openings 43 spaced around the liquid flow passageway 28. Similarly, passageway 38 terminates at the forward end of the body portion 14 in an annular air chamber 44 which also forms an air exit orifice on the forward face of body portion 14. This exit orifice can be annular or can be a series of circular openings.

Surrounding the nozzle assembly 16 is an air cap 46 which is secured to the spray gun body portion 14 by a retainer nut 48, with the rear face of the air cap engaging the forward face of the body 14. The cap incorporates a central air chamber 50 which receives the forward end of the nozzle 16, including the liquid passage 28 and the forward end of needle valve 20 and engages the air chamber 42 through openings 43. The cap includes an air outlet 52 around and concentric with the fluid orifice 26. This outlet may be a single continuous annular aperture or may be a series of circular apertures which cooperate to direct air from chamber 42 out of the nozzle assembly in such a way as to atomize the flow of liquid from aperture 26.

Extending forwardly from the air cap 46 are a pair of air horns 54 and 56 which contain corresponding air passageways 58 and 60. These passageways engage the annular chamber 44 and direct air from passageway 38 outwardly through air horn exit apertures 62 and 64 to shape the pattern of the liquid discharge. By regulating the rates of flow of the various streams of liquid and air, and by careful selection of the number and angle of the air exit ports formed in the air cap, a spray discharge having the desired shape may be produced. Typically, the air horn ports deflect the atomized particles into a fan shape for easy use of the spray gun.

Figure 2:
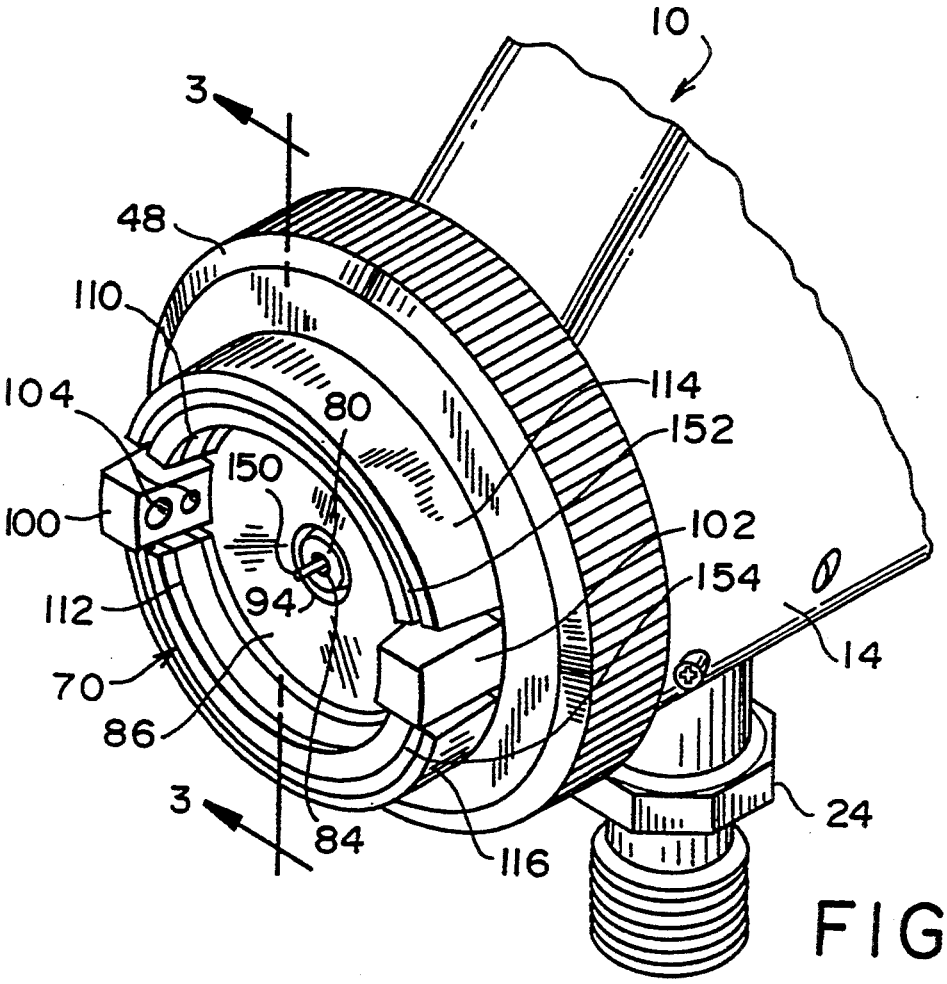
FIG. 2 is an enlarged, perspective, partial view of the air gun of FIG. 1 incorporating the improved induction charging cap of the present invention.

The improved air cap of the present invention is illustrated in one embodiment in FIGS. 2 and 3, to which reference is now made. The air cap, generally indicated at 70, is secured to a conventional spray gun, such as the hand held spray gun 10, by the retainer nut 48 which engages external threads 72 formed on an annular, forwardly extending portion 74 of the body portion 14. The annular portion 74 of the body surrounds a face portion 76 of the body 14 and defines a cylindrical receptacle in front of the annular air chambers 42 and 44 and the central liquid passageway 28, described above with respect to FIG. 1.

The central liquid passageway 28 is defined by a cylindrical wall 78 which extends to the face 76 of the spray gun body portion. This passageway wall is extended by a liquid nozzle extension 80 which is threaded to the forward end of wall 78 at 81. The nozzle extension 80 extends the liquid passageway 28 into an interior forwardly and inwardly tapered cavity 82 axially located within air cap 70 to provide a liquid exit orifice 84 at the forward face 86 of the cap. The axially adjustable needle valve 20 extends through the interior of fluid nozzle extension 80, with the tip 88 of needle valve 20 extending into orifice 84 to provide an annular exit passageway for the liquid being sprayed. In conventional manner, axial motion of the needle valve 20 opens and closes the orifice 84 to regulate the fluid flow.

The cap 70 includes a rear face 90 which is positioned adjacent the forward face 76 of the spray gun when the cap is secured to the spray gun. The rear face of the cap includes an annular shoulder portion 92 which surrounds the interior tapered cavity 82 and which extends rearwardly to engage the forward face 76 of the spray gun body at a location radially outwardly from the outlet of air chamber 42 so that the chamber 42 opens into the interior cavity 82 of the air cap. The shoulder provides a seal to prevent air from passageway 36 and cavity 42 from flowing radially outwardly and thus prevents intermixing of air from cavity 42 with air from cavity 44. This serves to direct the air from passageway 36 and cavity 42 into the tapered cavity 82 and forwardly through the cap to exit the cap from an annular air exit orifice 94 on the forward face 86 of the air cap, thereby providing a spray droplet flow passage 95 in front of the face 86. The annular orifice 94 surrounds the liquid nozzle extension 80 and thus surrounds the liquid exit orifice 84 to assist in the atomization of liquid being sprayed. Although the exit orifice 94 is illustrated as being annular in shape, it will be understood that it may be in the form of a plurality of circular orifices spaced around the nozzle extension 80. In addition to orifice 94, a plurality of air holes connected by passages through the air cap to air chamber 42 can be provided on face 86 of the cap to cooperate with orifice 94 in shaping and atomizing the liquid exiting from orifice 94.

Cap 70 preferably includes a pair of diametrically opposed air horns 100 and 102 spaced symmetrically on opposite sides of exit orifice 84. Each air horn includes one or more air outlets 104 (FIG. 2) which are connected by way of interior passageways (not shown in FIGS. 2 or 3) such as the passageways 58 and 60 of FIG. 1. These passageways terminate in air inlet openings (not shown) on the rear face 90 of air cap 70 for communication with the annular air chamber 44. As illustrated in FIG. 3, the face 90 of the air cap is spaced slightly away from the face 76 of the spray gun to provide another chamber 106 between the body 14 and the air cap 70. This chamber 106 provides communication between the air chamber 44 and the passageways 58 and 60 so that air supplied through passageway 38 is directed to the air horn outlets 104. As noted above, the shoulder 92 separates the air chamber 106 from the inner cavity 82 so that the air flow from orifice 94 is independent of the air flow from outlets 104.

The forward surface 86 of cap 70 incorporates a pair of curved electrodes 110 and 112 carried by forwardly extending electrode supports 114 and 116, respectively. These supports may be formed integrally with the cap, or may be separate elements fastened to the cap by, for example, screws or adhesive. In the illustrated embodiment, the air cap is of molded plastic, and the electrode supports are integrally formed therewith. The supports 114 and 116 are fabricated with forwardly and outwardly tapered conical inner surfaces 118 and 120, respectively, these conical surfaces being concentric with the liquid exit orifice 84 and the needle 20, with each electrode support being semicircular and extending substantially continuously between the air horns 100 and 102. The electrodes 110 and 112 are supported on supports 114 and 116 and may be carried on the respective surfaces 118 and 120 or may be formed in the electrode supports in the manner illustrated in FIG. 3. As there illustrated, the electrodes are a semiconducting plastic material such as carbon filled or doped acetal resin and are integrally molded within the supports 114 and 116, the electrodes lying in a plane perpendicular to the axis of the needle 20 and being spaced from the needle sufficiently far to provide the desired inductive charging of fluid particles emitted through the fluid exit orifice 84 around the needle 20. It will be understood that alternative electrode structures may be used; for example, the electrodes may be a metal or semiconductive coating deposited on the surfaces 118 and 120, or may be a metal foil. The latter is less desirable because of the possibility of sparking at the foil edges, and because of the mobility of charges through the material.

At least one conductor channel leads from the rear surface 90 of the cap to each of the electrodes 110 and 112 for connection of the electrodes to a suitable electrical power supply. In the embodiment illustrated in FIG. 3, conductor channels 122 and 124 lead to electrodes 110 and 112, respectively, and are filled with an electrically resistive material 125; for example, carbon doped plastic such as acetal resin or epoxy, which contacts the electrodes at one end, and which extends back to the rear surface 90. Mounted in the passageways 122 and 124 are corresponding wiper contacts 126 and 128 which extend rearwardly from the cap 70 and into annular chamber 44. The wiper contacts may be embedded in the resistive material 125 within the channels 122 and 124, may be molded into the plastic material of the cap, may extend through and be soldered to the corresponding electrodes 110 and 112, or may be otherwise secured in any desired way to provide a direct or a resistive electrical path to the electrodes. The free ends of the contacts 126 and 128 are curved to form spring contacts which contact an electrically conductive or semiconductive annular sleeve 130 mounted on the inner wall of air chamber 44 or alternative electrically conductive surfaces mounted in the front portion of body 14. Sleeve 130 is connected by way of line 132 to a suitable power supply (to be described) which may be separate from the air gun or mounted thereon. The power supply provides current to the sleeve or other conductive or semiconductive surface 130 which is transferred by way of wiper contacts 126 and 128 to electrodes 110 and 112 through the resistive material 125 in passageways 122 and 124. The resulting potential on the electrodes 110 and 112 produces an electrostatic field in the region 95 in front of the air cap 70 which field extends into the region of the fluid exit orifice 84 so as to induce charges on fluid particles ejected under pressure from the spray gun.

As illustrated in FIGS. 2 and 3, the air cap 70 is generally cylindrical, with an outer circumferential surface 140 having an outwardly extending shoulder portion 142 which fits within the cylindrical receptacle, or socket formed by the outwardly extending sleeve 74 on the face of the air gun 10. The socket is defined by inner cylindrical wall 144 and receives the air cap 70 for attachment to the air gun. The retainer nut 48, which preferably is plastic includes a central aperture 146 which slides over the outer wall 140 of the air cap and engages the shoulder portion 142 to secure the air cap in place when the retainer nut is threaded onto the air gun, while leaving air cap rotatable within the socket so that the air horns can be located at any desired angular position. The wiper contacts 126 and 128 maintain electrical connections between the electrodes and the power supply at any angular position and the cooperating shapes of the air and liquid passageways in the cap and in the spray gun maintain a continuous air and liquid flow, so that the spray is undiminished when the cap is rotated.

Although the needle portion 88 terminates at or near the orifice 84, approximately in the plane of the front surface 86 to control the liquid flow, it may be desirable in many cases to provide a needle extension, or probe, indicated at 150 in FIGS. 2 and 3, which may extend forwardly of the front wall 86 by about $\frac{1}{4}$ inch. This needle extension may be approximately 0.030 inch in diameter, preferably is metal, although it can be made of plastic, and is electrically grounded by virtue of its attachment to the needle valve 20, which is electrically grounded through the spray gun 10 or by direct connection to electrical ground. The probe 150 can be integral with the needle 20, or it can be attached by threads or press fit onto the tip portion 88 of the needle. Operationally, the probe acts to spread the fluid out as it leaves the orifice 84 to provide a more complete interaction with the electrostatic field produced by the electrodes 110 and 112. A secondary function of the probe is to act as a corona source when low conductivity liquids are sprayed. In this situation, the probe 150 would be conductive and sharpened to enhance the corona effect. The probe diameter can vary and will depend on the size of the nozzle orifice so as to preserve the desired liquid flow gap. In general, the size of the probe will vary linearly with changes in the diameter of the liquid flow orifice with a probe diameter of about 0.030 inch being about optimum for an orifice having a diameter of between about 0.050 and 0.060 inch.

The forward faces of the electrode supports 114 and 116 may incorporate one or more grooves 152 and 154 to lengthen any leakage path that may occur between the electrodes 110, 112, and the body of the spray gun, thus reducing leakage currents and preventing unwanted short circuits. A groove 1/16 inch deep by 1/16 inch wide has worked well in one embodiment of the invention. Although a single groove is shown on each electrode support, multiple grooves can be provided to further increase the leakage path, the number of grooves being dependent, to some extent, on the thickness of the forward faces 114 and 116, as well as considerations of manufacturing ease, durability, and ease of cleaning the cap.

The system as described above is very spark resistant because of the inherent small capacitance of the cap, electrodes, and the like. In addition, if the electrodes 110 and 112 are formed of semiconductive material, spark resistance is enhanced. Further spark resistance can be achieved by replacing the semiconductive plastic material 125 within channels 122 and 124 with small fixed high voltage resistors in the range of 100 megohms. Such resistors, in combination with appropriate resistors in the range of about 1 Gigohm in the spray gun body, result in a virtually sparkless system, even with the electrodes at 12 KV.

FIG. 4 illustrates an embodiment wherein the resistive material 125 in channel 122 is replaced by a resistor 160. In this case, the electrode 110 incorporates a connector post 162 which is formed integrally with the electrode and is molded into the plastic air cap, the connector post being conductive or semiconductive and including a spring contact 164 for engaging one end of the resistor 160. The resistor is secured in channel 122 against spring contact 164 by means of a press fit fastener 166 which receives the opposite end of the resistor 160 and which is secured into an enlarged portion 168 of the channel. Also received in an aperture 170 formed in fastener 166 is one end of the wiper contact 126, the contact extending through the aperture to engage the end of resistor 160.

Although the electrodes 110, 112 illustrated in FIGS. 2, 3, and 4 are generally cone-shaped by reason of their location on the generally forwardly and outwardly sloping surfaces 118 and 120, it may be desirable in some applications to fabricate generally cylindrical electrodes located on cylindrical surfaces of the air cap or of the electrode supports. In addition, in some applications air horns may not be required for shaping of the liquid spray particles, in which case a single circular electrode coaxial with the axis of the air cap can be provided. FIG. 5 illustrates in partial section a modified air cap 180 in which a single cylindrical electrode 182 is provided on an inner cylindrical surface 183 of the air cap or of an annular electrode support secured to the air cap. The electrode can be a semiconductive coating or, in the alternative, can be fabricated as a separate element and snapped into place or molded into position on the air cap or on the electrode support. The electrode 182 is connected to a power supply by way of one or more wires 184 which are connected to the electrode 182 and which extend rearwardly through passageways 186, 188 for connection through a suitable rotatable connector 189 to the power supply. The connector may be fabricated in the manner illustrated with respect to FIG. 3, or may take the modified form illustrated in FIG. 5. In the embodiment of FIG. 5, the connection between the rotatable cap 180 and the stationary air gun 14 is formed by way of a conductive or semiconductive sleeve 190 on the outer surface of air cap 180. The sleeve 190 may be a semiconductive coating on the outer surface of the shoulder 192 of the air cap, this shoulder being engaged by the retainer 48 to secure the air cap to the front face of the spray gun in the manner illustrated with respect to FIG. 3. The wire 184 extends through the cap 180 and is connected, as by soldering, to the sleeve 190, as at 194. Alternatively, the sleeve 190 can be made of semiconducting plastic and press fit onto the outer surface of the air cap in physical and electrical contact with wire 184, or the wire can be terminated flush with the cap surface and a semiconductive coating applied to the surface.

In the embodiment of FIG. 5, the connection between the air cap 180 and the spray gun 14 is completed by means of a spring clip 196 mounted on the face of the spray gun 14, one end of the clip extending through an aperture 198 in the face 76 of the spray gun and extending forwardly into a groove 200 on the inner surface 201. When the air cap 180 is drawn up against the face of the air cap 14 by retainer 48 into the socket formed by surface 201, contact is made between the forward end of spring clip 196 and the conductive sleeve 190 for connection to a power supply by way of conductor 202 connected to rearwardly extending free end of spring 196.

Spring 196 may be a formed wire, such as music or "piano" wire, as illustrated at 196' in FIG. 6 or can be sheet metal, as illustrated at 196" in FIG. 7.

The charging electrodes, whether the cone shaped electrodes 110, 112, or the cylindrical electrode 182, are positioned, in a preferred form of the invention, at a perpendicular radius of approximately 0.55 inches from the axis of the spray nozzle 84 in the air cap. The air cap has an outer diameter of approximately 1.5 inches and a front surface 210 (FIGS. 3 or 5) which extends forwardly approximately 0.170 inches in front of the cap face 86. The surface on which the electrode is carried has an active area of approximately 0.587 square inches, reduced by the portion of the surface which is removed to provide for the air horns 100 and 102 and any air gaps between the air horns and the electrode supports 114, 116. This results in an active electrode area of about 0.434 square inches, in one embodiment of the invention. Air caps may be fabricated in a range of sizes to accommodate different spray guns and/or different spray rates, and accordingly the size and spacing of the charging electrodes may also vary. Larger diameter air caps would permit the use of larger diameter electrodes, roughly in the same proportion, and the active electrode area similarly could be varied, roughly in proportion to cap diameter. The electrode area must be made large enough to efficiently charge the liquid being atomized by the spray gun and cap. It should be noted that a minimum electrode size is preferred, since large electrodes block air flow into the spray region, and can also be too attractive to the charged particles. A preferred range of electrode dimensions for a cylindrical electrode would be a radius of 0.4 to 0.7 inch perpendicular to the axis of liquid orifice, with a forward projection, or axial length, of 0.1 to 0.3 inch, producing a minimum active electrode surface area of 0.25 to 1.3 square inches.

In the embodiment of FIG. 5, the inner cylindrical surface which carries electrode 182 flares inwardly at region 212 at an angle of about 45° from the electrode, and semiconductive material extends onto at least a part of this region for the purpose of making a connection with the wire 184. As also illustrated in FIG. 5, a plurality of apertures 214 can be provided behind the electrode 182 and extending outwardly through the cap as indicated in phantom at 216 to permit ambient air to be aspirated into the flow path of the atomized particles. In addition, or alternatively, a series of notches, indicated at 218, can be cut in the air cap rim to facilitate ambient air flow into the particle flow path, although this reduces the electrode area. Any number of apertures 214 or notches 218 can be provided to accommodate the desired air flow, as long as the required electrode area is maintained. Similar apertures or air flow notches can be provided in the embodiment of FIG. 3, as well. To provide maximum air flow, the electrodes in the air cap of either FIG. 3 or FIG. 5 can be supported by a web structure, if desired.

The conical electrodes carried by surfaces 118 and 120 (FIG. 3) form an angle of about 30° with the spray nozzle axis, in one embodiment of the invention, and provide an electrode surface area which is comparable to that of the cylindrical electrode 182 shown in FIG. 5.

FIGS. 8 through 11 illustrate a third embodiment of the present invention wherein an air cap 220 is mounted on a conventional spray gun, in this case an automatic spray gun generally indicated at 222. The air cap 220 is similar to air cap 180 illustrated in FIG. 5, but in this case includes two curved electrodes 224 and 226 mounted on curved electrode supports 228 and 230, respectively secured to the front face 232 of the cap. The electrodes in this case are generally semicylindrical and extend rearwardly at 224' and 226' to provide electrical connections through wires 234 and 236 to the connector structure 237 which extends between the air cap 220 and the spray gun 222. The air cap 220 differs from cap 180 in the provision of a pair of air horns 240, 242 having air outlet apertures 244, 246 connected through corresponding air passageways 248 and 250 (FIG. 10), to engage the annular air supply chamber 252 (FIG. 8) formed at the front face of spray gun 222.

The front surface 254 of the air cap 220 includes grooves 256 and 258 which extend the length of the front surface leakage path to the grounded spray gun body, minimizing the possibility of an undesirable voltage reduction when spraying in a humid and/or contaminated atmosphere.

Figure 9:
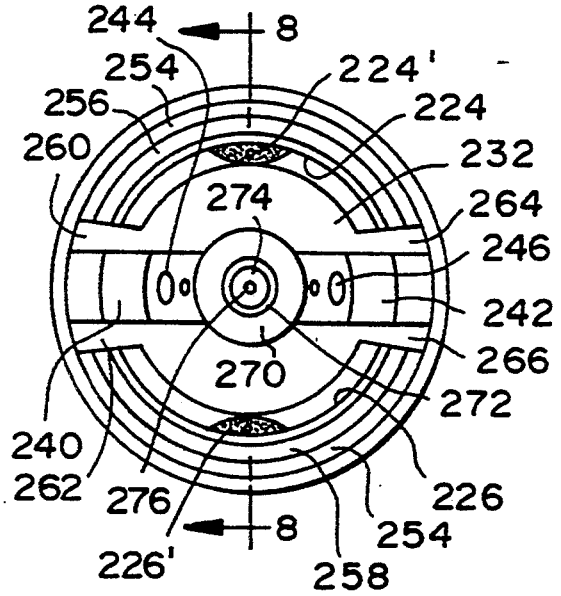
FIG. 9 is a front elevation view taken along lines 9—9 of the air cap of FIG. 8.
Figure 10:
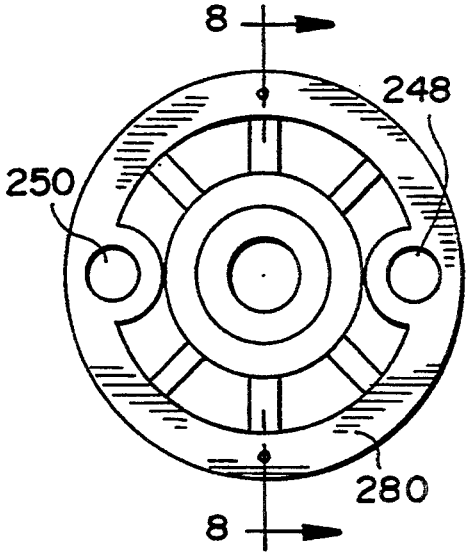
FIG. 10 is a rear elevational view taken along lines 10—10 of the air cap of FIG. 11.
Figure 11:
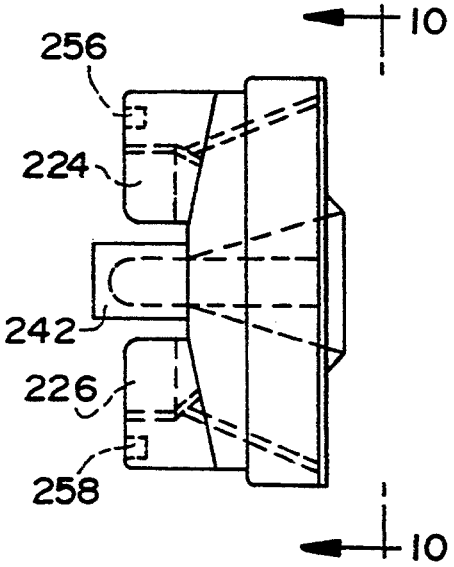
FIG. 11 is a side elevation view of the air cap of FIG. 8.

The curved electrode supports 228 and 230 preferably are semicylindrical, and stop short of the air horns 240 and 242 to provide air flow apertures 260 and 262 on each side of air horn 240, and air flow apertures 264 and 266 on each side of air horn 242 (see FIG. 9). These apertures extend to the exterior surface of the cap to allow external ambient air to be aspirated into the spray zone 95 of the air cap for mixture with the pressurized air and liquid particles produced by the spray gun in order to improve the flow of particles and to reduce turbulence.

The air cap 220 includes a central tapered aperture 270 through which the liquid spray nozzle 272 extends. Liquid to be sprayed is expelled through nozzle aperture 274, with the needle valve 20 extending into the aperture to control the flow rate, as previously described. In the preferred form of the invention, a needle extension probe 276 is also provided, the probe extending through the aperture 274. The spray gun nozzle aperture 274 is surrounded by the tapered air aperture 270, as previously described.

Figure 12:
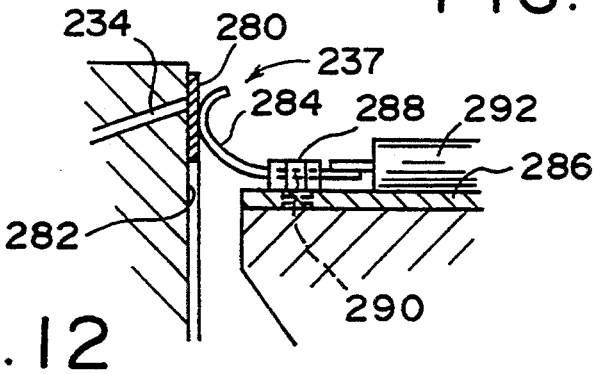
FIG. 12 is an enlarged partial view of the connector spring wiper arm utilized in the embodiment of FIG. 8.

In the embodiment of FIGS. 8–11, a modified connector 237 is provided to connect the rotatable cap 220 to the power supply carried by spray gun 222. This connector is illustrated in enlarged form in FIG. 12, and includes a conductive ring 280 on the rear surface 282 of cap 220. The ring 280 may be a semiconductive coating or may be a metal or semiconductive plastic ring molded into or snapped into a matching cavity in the rear surface. The ring is connected to wires 234 and 236, as by soldering, to provide electrical connections to the electrodes 224 and 226. A sliding connection is provided by spring wiper contact 284 which may be a wire connected to a nonconductive sleeve 286, for example, by way of a screw 288 having an aperture 290 through which the spring wire 284 extends. The screw is secured in the sleeve 286. Wire 284 may be connected, for example, through a suitable resistor 292 and wire 294 to a suitable power supply.

Figure 13:
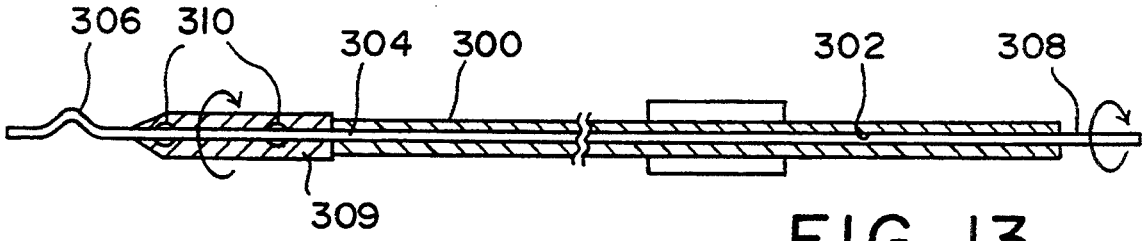
FIG. 13 is an enlarged view of a second embodiment of a flow control needle usable in the air caps of FIGS. 2 through 12.

A modified form of the needle valve 20 utilized in the spray gun discussed above is illustrated in FIG. 13, wherein needle 300 includes a hollow axial passageway 302 through which a rotatable probe 304 extends. The probe 304 includes at its forward end an offset or paddle portion 306 which will produce a mixing action for the atomized liquid particles which are ejected from the liquid orifice surrounding the needle, such as the orifice 84 in FIG. 3 or 274 in FIG. 8. The mixing action occurs when the probe 304 is rotated, as by an electric or an air driven motor connected to its rearward end 308. The needle probe may be rotated at a few hundred to a few thousand rpm in the liquid stream emerging from the fluid nozzle during spraying, and this tends to spread the fluid and to push the atomizing sites radially outwardly so that they can be more effectively exposed to the electric field supplied by the surrounding induction electrodes, such as the electrodes 224 and 226 in FIG. 8. The effect is to break up and charge the spray droplets more uniformly to increase the charging and deposition efficiency of the system. The drive motor can be mounted internally or externally of the spray gun and can be powered from a low voltage feed from the high voltage supply source in the gun. The provision of a rotating probe 304 does not adversely effect the valving action of the needle valve 300. A relatively rotatable tip 309 for needle 300 is secured to probe 304 by means of flares or flutes such as those illustrated at 310 and rotates with the probe, while needle 300 remains fixed. When the spray gun is switched off (by releasing the trigger 18) the probe drive motor is turned off and tip 309 stops rotating as the needle valve 300 moves axially to close off the liquid flow. Alternatively, tip 309 and needle 300 can be one piece, supported for rotation by bearings.

Figure 14:
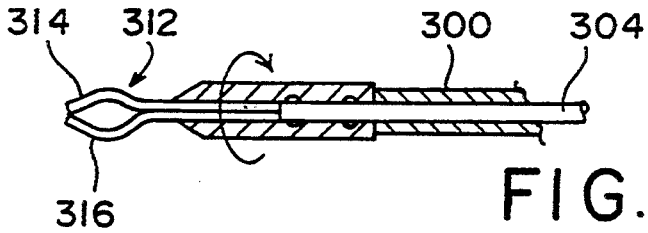
FIG. 14 is a third embodiment of a flow control needle.

The forward end of the probe 304 can take a number of forms to provide the desired mixing action. One alternative is illustrated in FIG. 14, for example, wherein the distal end 312 of the probe is bifurcated to provide a pair of collapsable spring wire paddles 314 and 316. The probes 304 illustrated in FIGS. 13 and 14 have the advantage that they are easily insertable into the fluid nozzle and can be easily withdrawn for cleaning or replacement.

Figure 15:
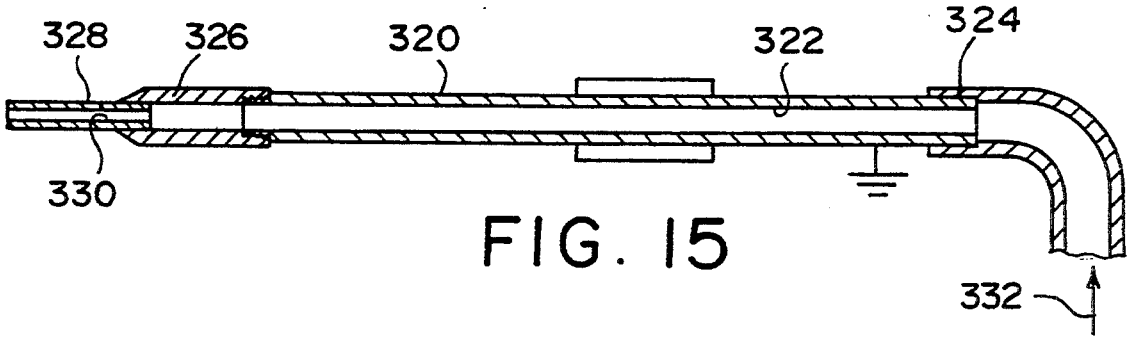
FIG. 15 is a fourth embodiment of a flow control needle for use with the air cap of the present invention.
Figure 16:
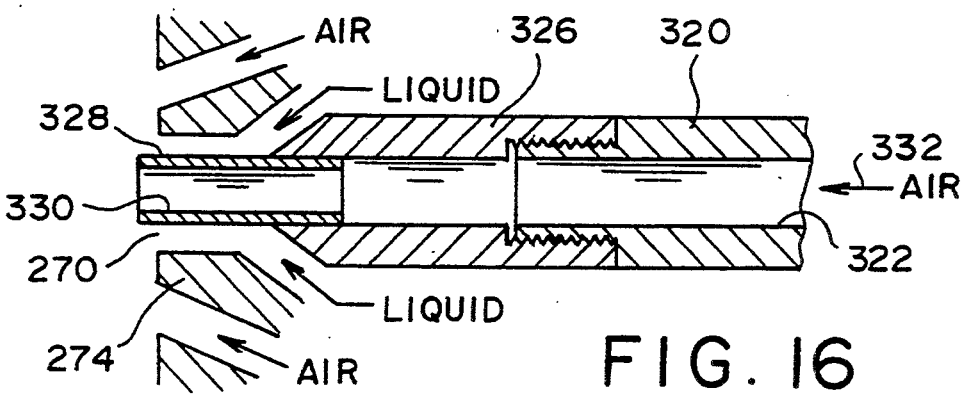
FIG. 16 is an enlarged view of the flow control needle of FIG. 15.

Another form of the control valve needle 20 is illustrated in FIGS. 15 and 16 wherein the needle 320 is hollow, having an axial aperture 322 extending from the rearward end 324 of the needle to the distal end 326. A probe 328 secured to the end of needle 320 is also hollow, having an interior axial aperture 330 aligned with aperture 332. The probe 328 extends through the liquid aperture 270 (FIG. 8) to direct air from a source indicated by arrow 332 into the spray region in front of the nozzle, providing an axial gas stream which forces atomization sites radially outwardly for better exposure to the electrostatic field. This air stream has a high velocity and low volume, compared to the air flow parameters for the spray gun, and thus assists in achieving a more complete droplet charging in the induction field. The internal air stream also acts to more completely break up droplets that are normally larger in the central part of the fluid stream. The probe 328 can be a blunt-tipped metal hypodermic needle tube, and the air supply 322 can be from a separate source outside the spray gun, with its own valve control, or can be tapped from an air passage inside the spray gun.

Figure 17:
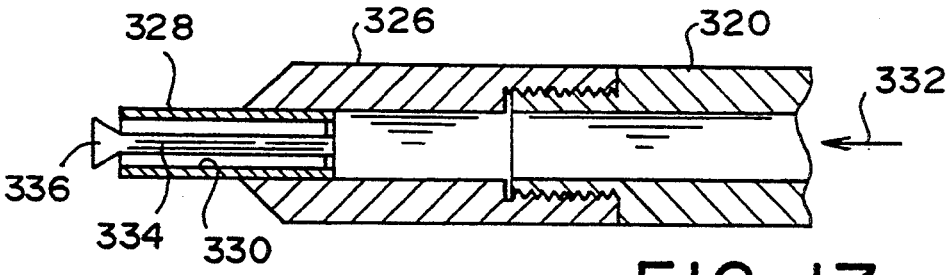
FIG. 17 is an enlarged cross sectional view of a fifth embodiment of the flow control needle of the present invention.

A modification of the device of FIGS. 15 and 16 is illustrated in FIG. 17, wherein the probe 328 incorporates a central diverter 334 having a flared tip 336 which tends to spread the air exiting from the central aperture 330 to provide a greater radial component to the exiting air.

Figure 8:
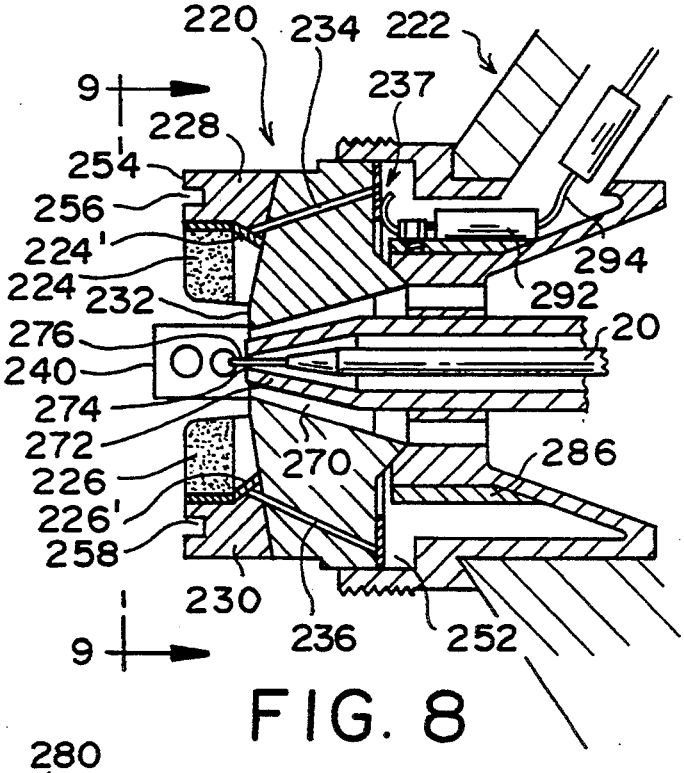
FIG. 8 is a partial cross sectional view of a fourth embodiment of the air cap of the present invention taken along line 8—8 of FIGS. 9 and 10, and illustrating a modified electrode structure and a fourth connector spring wiper arm arrangement.
Figure 18:
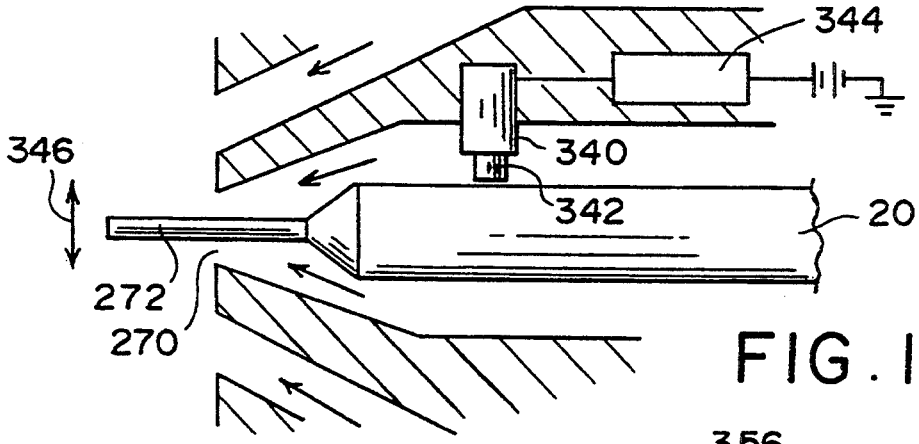
FIG. 18 is an enlarged partial cross sectional view of a sixth embodiment of the fluid flow control nozzle of the present invention.

Another modification of the needle tip is illustrated in FIG. 18, wherein the needle valve 20 carries a probe tip such as the tip 272 illustrated in FIG. 8. In this case, a transverse driver element 340 is positioned close to the needle 20, the driver element having a plunger 342 which engages the side of the needle. Activation of the driver through a suitable driver circuit 344 causes the plunger to be actuated at a rate of up to several thousand Hz, driving the tip transversely and causing the probe 272 to oscillate in the manner indicated by arrow 346. This oscillating movement of the probe 272 assists in breaking up and atomizing the liquid passing through aperture 270 and forces the liquid droplets radially outwardly for improved induction charging. The driving frequency is adjusted to resonance levels for the oscillating probe tip to achieve maximum energy transfer into the atomization process.

In accordance with the invention, the liquid nozzle 80 (FIG. 3) or 274 (FIG. 8) is constructed of a dielectric material such as plastic when the liquid being sprayed is of low conductivity. Plastic has the advantage of somewhat more efficiently concentrating the field lines from the electrodes on the liquid and on the probe. This permits the use of higher applied voltages for better charging of the fluids, and permits the use of corona effects to assist in the charging process. For conductive liquids, such as water-borne and other conductive paints, the nozzle may be conductive; for example metal, since it is more durable and retains its dimensional stability better than plastic.

The forward location of the induction electrodes and their extended surfaces around the circumference of the liquid spray path allows optimal shaping and sizing of the electrodes, as well as positioning of the electrode structure to achieve maximum induction and, when required, corona charging, for an HVLP spray. The structure is consistent with maintenance of a smooth, non-contaminating, aspirated air flow around the spray head and through the apertures 260, 262, 264, and 266 (FIG. 9) as well as optional apertures 214 and 218, without producing a significant voltage drop on the electrodes due to surface current leakage or arcing to grounded portions of the spray gun, the metal fluid nozzle, or the fluid stream itself. The liquid being sprayed is maintained at or near ground potential, and the electrode system is connected internally, as by wires, resistors, and/or semiconducting contact surfaces, to permit a sliding contact between the air cap and the spray gun. This permits 360° orientation of the spray fan and incorporation of additional arc and spark suppression resistors close to any potential point of contact.

Figure 19:
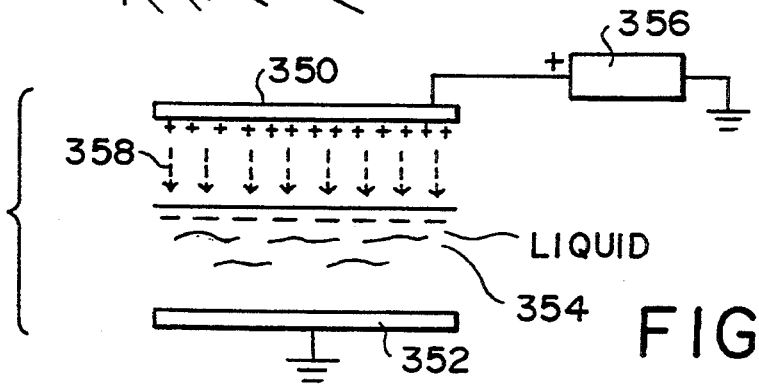
FIGS. 19, 20, 21, and 22 illustrate the process of forming induced charges in particles.

The voltage applied to the induction electrodes, such as electrodes 110, 112 in FIG. 3 and electrodes 224, 226 in FIG. 8 provides inductive charging for conductive liquids and corona charging for nonconductive liquids, the induction charging producing charge droplets having a polarity which is opposite to that of the polarity of the voltage applied to the electrodes. The process of induction charging is illustrated in FIGS. 19–22 wherein the plate 350 represents an induction electrode, and plate 352 represents the ground potential of the control needle valve 20 (or its equivalents) shown in FIGS. 13–18. The liquid being sprayed may be, for example, a conductive liquid such as water-borne paint 354. If a positive voltage is applied to electrode 350, as from a high voltage source 356, an electric field 358 (FIG. 19) is established between the electrode and the surface of liquid 354. The field lines 358 are uniform when the liquid surface is quiescent and in the absence of an air flow between the electrode 350 and the liquid. As illustrated in FIG. 19, this electric field induces at the surface of the liquid a compensating, or image, charge which is of opposite polarity to the charge applied to electrode 350.

Figure 20:
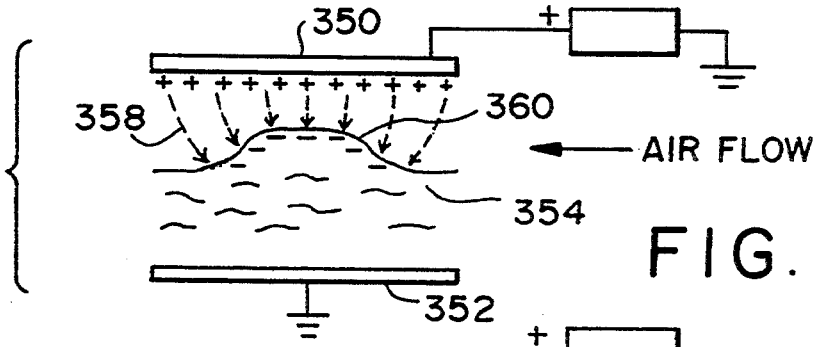
Figure 21:
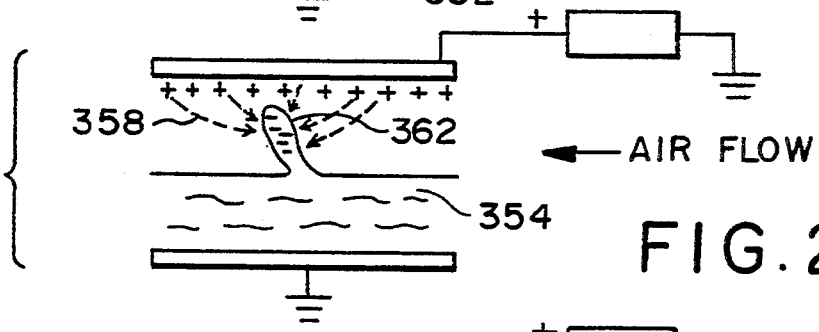

When air starts to flow across the surface of the liquid 354 at a low velocity, a moderate distortion of the fluid surface begins, as illustrated at 360 in FIG. 20, and this distortion causes the negative charges in the liquid surface to begin to concentrate at regions of higher curvature, where the surface of the liquid is closer to electrode 350. This also causes some concentration of the field lines 358. A higher air flow velocity, as indicated in FIG. 21, causes severe distortion of the liquid surface, as indicated at 362, producing a high concentration of negative charges at liquid tips formed on the surface of liquid 354.

Figure 22:
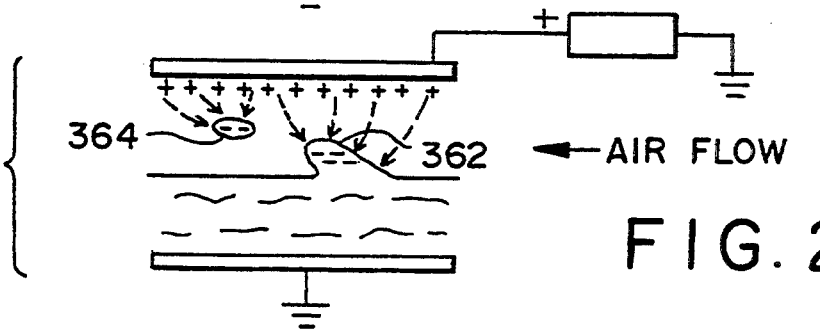

When the air flow increases to a velocity sufficiently high to produce atomization of the liquid, as illustrated in FIG. 22, charged droplets 364 break off of the tips 362 and are eventually blown out of the electrode system. This process results in negatively charged droplets 364 which can then be directed toward a work piece in the manner illustrated in FIG. 23. As there shown, negatively charged droplets 364 are directed by the air flow produced from spray gun 366, which may be any of the spray guns previously described, the air flow directing the droplets toward a work piece 370. This work piece may be grounded and/or electrically nonconductive, with the negatively charged particles producing a spray cloud 372 which effectively coats the work piece. The spray cloud is devoid of unattached gaseous ions such as would be present in a conventional high voltage-generated spray.

If the voltage applied to the electrodes is very high and the liquid being sprayed is very conductive, gaseous ions will be produced at the liquid tips, but these will be attracted to the positive electrode and the spray 372 will still be free of gaseous ions. It is noted that in the illustration of FIGS. 18–22, a positive potential is applied to electrode 350 and the droplets are negative. However, it should be understood that if the applied potential is negative, the droplets will be positively charged. This differs from conventional high voltage air spray painting systems where the fluid is in direct contact with the high voltage needle, and the droplets are charged to the same polarity as the needle. Ions are always present in such systems. It is noted in the illustrations in FIGS. 18–22, that the liquid is presumed to be stationary. However, it will be understood that the liquid can also have a velocity to assist in formation of droplets, without departing from the above theoretical considerations.

As illustrated in FIG. 23, a nonuniform electric field produced by the induction electrodes carried by the air cap extends forwardly of the air cap and around the exterior of the cap back to the grounded metal body of the spray gun or to other grounded regions or attachments located behind, but close to, the spray head, thus deflecting the charged liquid droplets and keeping the gun cleaner. Higher applied voltages produce higher fields and more deflecting force. However, higher applied voltages also produce corona off sharp electrode corners and edges, which is undesirable.

The preferred voltage level at the induction charging electrodes is about 10 KV, although it has been found that for charging conductive and semiconductive liquids, a voltage between about 5 KV and 10 KV can be used with good results, and in some cases a range of 2–12 KV can be used. If a poorly conducting liquid is to be sprayed, corona charging is needed, requiring a voltage of at least 12 KV and preferably 15–20 KV. This voltage is needed to penetrate the combined effects of charged liquid droplets and screening ions to produce the corona effects at a grounded, sharpened needle tip or probe in the center of the spray stream.

As illustrated in FIG. 24, the spray gun 366 may be connected to a suitable power supply which includes a DC or AC primary source 380 which may produce, for example, ten to twenty volts DC at 500 milliamps and a control box 382 which includes an on-off switch 384, an optional battery switch 386, and a potentiometer 388. In addition, a ground jack 390 for a grounding cable may be provided, and a voltmeter 392 is provided to permit selection of the voltage to be supplied to the induction electrode. The output of the control box is supplied by way of lines 394 to a high voltage circuit 396 mounted on or integral with the spray gun 366. The high voltage circuit converts the output from the control box to a voltage typically between 5 and 10 KV for application to the induction electrodes. The on-off switch 384 may incorporate not only a manual switch but a gas (air) flow-sensing switch responsive to gas flow to the spray gun. When the gun 366 is turned off by releasing the spray control trigger, the gas flow is switched off, or at least drastically reduced, to operate the flow-sensing switch and to cut off the power supplied to the gun. Although not shown, it should be understood that control box 380 may be used to power a number of spray guns 366 simultaneously. Also, the high voltage circuit 396 could supply multiple induction spray nozzles on one spray gun 366.

Figure 26:
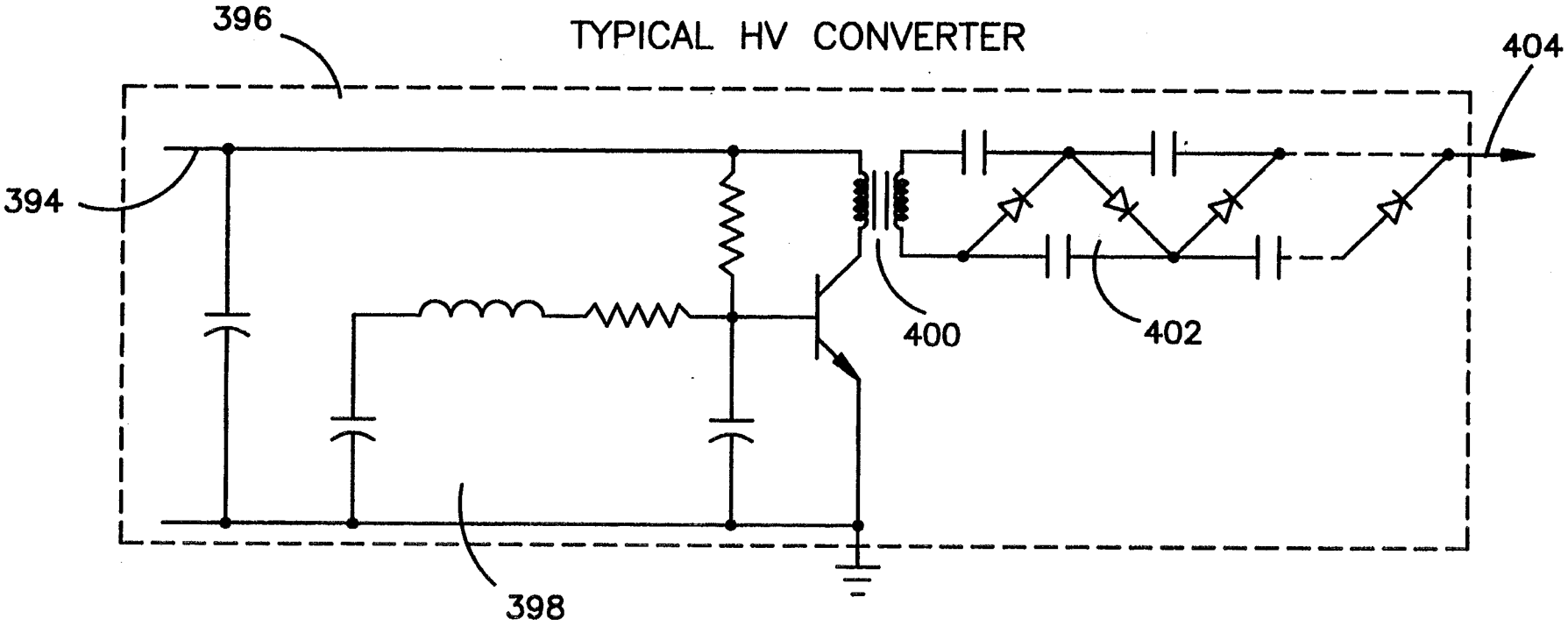
FIG. 26 is a diagrammatic illustration of a high voltage circuit for use with the power supply of FIG. 25.

The high voltage circuit 396 can take several forms, one of which is illustrated in FIG. 26, wherein the DC voltage on line 394 is first converted to AC in oscillator circuit 398 and then is transformed to a high voltage AC by means of high frequency transformer 400. Typically, the high voltage AC signal is further multiplied and converted to DC in a voltage multiplier ladder circuit 402 for supplying DC of either plus or minus polarity to the spray gun electrodes by way of output line 404. Alternatively, it can be a floating power supply capable of providing both polarities, on demand. Such a dual output supply can be cycled between positive and negative voltage levels for special coating situations. For example, it may be desired to provide a number of layers of paint or other coating material on a nonconductive and poorly grounded workpiece, such as untreated plastic. This can be done by providing opposite charges on the spray droplets for alternate passes with the spray gun, first applying a positively charged spray and then applying a negatively charged spray, or vice versa. This results in maximum deposition of charged droplets, with minimum repulsion of incoming spray droplets by the existing layer of coating material on the workpiece. The time for a complete cycle would typically be many seconds, although faster timing cycles (alternating between + and −) could be used to minimize Faraday caging repulsion effects when spraying the inside of cavities in nonconductive parts.

Instead of providing a single power supply, it is possible to incorporate two high voltage circuits, or modules, on the spray gun, one with a positive output and the other with a negative output. The on-off cycles of the two power supplies could then be regulated by appropriate programming circuitry in the control box 382. Another alternative for the power supply is to provide an alternating current signal, typically a sine wave of a few KV amplitude and a frequency of 0.1 kHz to 60 kHz, superimposed on a DC voltage. The DC level would be sufficient to produce inductive charging of droplets, while the AC would improve the conditions for droplet size control and charge distribution.

The spray gun structure of the present invention integrates induction electrodes, electrode supports, and high voltage sliding contacts with a high volume, low pressure air cap for improved spray charging. No structure extends forward of the air horns or behind the air cap so that the improved structure is easy to use, replace, and clean, is low in manufacturing costs, is compact, reliable, and durable, and has very low capacitance so that problems due to sparking and arcing are reduced. The device includes built-in electrical resistance paths to the induction electrode to impede charge transfer and further reduce sparking and arcing, and has no protruding high voltage contacts that can be damaged in use. The air cap can be rotated 360° so that the operator can selected the spray fan angle best adapted for coating specific work pieces, and the air cap of the invention is interchangeable between hand guns and automatic guns, saving manufacturing expense. The air cap combines good aspirated air flow around the spray head with relatively large electrode surface area so that electrostatic spraying of water born materials from electrically grounded containers can be carried out with relative ease. The combination of features provides faster coating in HVLP spray guns with significantly better coating uniformity and significantly higher application efficiency. The device permits spraying of paints containing metal flakes and allows good flake control, which is not possible with conventional high voltage systems. Although the invention has been described in terms of preferred embodiments, it will be apparent to those of skill in the art that numerous additional variations can be made without departing from the true spirit and scope thereof, as set forth in the accompanying claims.

What is claimed:

1. A method of spraying conductive liquids comprising:

supplying liquid to be sprayed to a liquid orifice;

electrically grounding said liquid;

supplying a high volume of air under low pressure to an air orifice adjacent said liquid orifice;

producing an electric field in a charging region surrounding said liquid orifice by means of at least one charging electrode having a voltage with a first polarity;

simultaneously expelling said low pressure air through said air orifice and said liquid through said liquid orifice to atomize said liquid to produce a turbulent spray stream of liquid droplets;

directing said turbulent spray stream through said charging region to produce liquid droplets charged to a second polarity;

producing a mixing action within said expelled liquid to produce additional turbulence in said spray stream of liquid droplets to expand the spray stream outwardly from said orifice toward said at least one charging electrode to enhance atomization and to enhance the charging of said liquid spray stream in said charging region; and directing said charged droplets in said spray stream toward a target.

2. The method of claim 1, further including directing a shaping air flow against said atomized droplets to produce a patterned spray.

3. The method of claim 2, further including rotating said shaping air flow with respect to said liquid spray orifice to rotate said patterned while retaining said voltage on said charging electrode.

4. The method of claim 1, wherein the step of producing an electric field includes supplying a voltage of between about 5 and 12 KV to electrodes at least one charging electrode adjacent said region.

5. The method of claim 1, wherein the step of producing an electric field includes supplying a voltage to at least one electrode adjacent said region which is sufficiently high to produce charges of said second polarity in said liquid spray stream in the absence of ionization of any air in said region.

6. The method of claim 1, wherein the step of producing a mixing action includes expelling air through an aperture centered in said liquid orifice to assist in the atomization of said liquid and the charging of said droplets.

7. The method of claim 1, wherein the step of producing a mixing action includes producing turbulent flow in said liquid as it is expelled from said liquid orifice to enhance atomization of the liquid and charging of said droplets.

8. The method of claim 1, wherein the step of producing turbulent flow includes spreading the liquid droplets radially outwardly from said liquid orifice.

9. The method of claim 7 wherein the step of producing turbulent flow includes driving a movable probe for relative motion within and with respect to said liquid orifice.

10. The method of claim 1, wherein the step of producing an electric field includes supplying a voltage having an alternating current component superimposed on a direct current component to electrodes adjacent said region.

11. The method of claim 1, wherein the step of producing an electric field includes supplying a voltage of selectable polarity to said charging electrode.

12. A high volume, low pressure spray apparatus comprising:

a spray gun having a front face;

at least a first air passageway in said spray gun terminating at said front face for delivering air at high volume and low pressure;

at least a first liquid passageway in said spray gun terminating at said front face for delivering liquid to be sprayed;

an air cap;

means for mounting said air cap on said front face of said spray gun for rotation with respect to said spray gun;

an air orifice in said cap;

a second air passageway in said cap for engaging said first air passageway at said front face and for delivering said air through said air orifice to a flow path;

a liquid nozzle connected to said first liquid passageway for receiving liquid, said nozzle having a forward end providing a liquid outlet orifice for discharging liquid as a liquid spray along said flow path, said liquid outlet orifice being adjacent said air orifice;

a needle control valve movable within said nozzle to control the flow of liquid to said liquid outlet orifice, thereby to control the discharge of said liquid;

electrode means adjacent said liquid outlet orifice; and rotatable contact means for electrically connecting said air cap to said spray gun to supply to said electrode means a voltage having a first polarity while permitting rotation of said cap with respect to said spray gun, said voltage being sufficiently high to produce an electric field in said flow path to thereby produce charges having a second polarity on said liquid spray.

13. The apparatus of claim 12, further including a target for receiving said liquid spray, said target being electrically grounded.

14. The apparatus of claim 12, wherein said spray gun and said liquid supplied to said liquid outlet orifice are electrically grounded, said electric field extending from said electrode means through Said flow path to said grounded spray gun.

15. The apparatus of claim 14, wherein said liquid is electrically conductive.

16. The apparatus of claim 15, wherein said liquid nozzle is concentric with said air orifice to atomize said liquid flowing from said nozzle to produce said liquid spray.

17. The apparatus of claim 16, wherein said needle control valve includes means producing turbulent flow in said liquid to produce improved atomization and enhanced production of charges in said spray.

18. The apparatus of claim 17, wherein said means producing turbulent flow comprises a central air aperture extending through said needle control valve.

19. The apparatus of claim 17, wherein said means producing turbulent flow comprises rotatable paddle means extending through said needle control valve.

20. The apparatus of claim 17, wherein said means producing turbulent flow comprises vibrator means.

21. The apparatus of claim 12, wherein said contact means includes electrical connector means between said spray gun and said cap for maintaining an electrical connection therebetween at any rotational angle of said cap.

22. The apparatus of claim 21, wherein said connector means includes a spring contact on one of said spray gun and said cap and an annular contact on the other of said spray gun and cap, said spring contact engaging said annular contact.

23. The apparatus of claim 21, further including a voltage source for supplying an induction voltage; means connecting said source to said rotatable contact means; and resistor means connected between said source and said electrode means.

24. The apparatus of claim 23, wherein said voltage source for supplying an induction voltage includes a supply source of alternating polarity direct current.

25. The apparatus of claim 23, wherein said voltage source for supplying an induction voltage includes a direct current supply source of selected polarity and an alternating current superimposed thereon.

26. The apparatus of claim 12, wherein said first air passageway delivers air through said second passageway to said air orifice at a high volume of between about 5 and 60 cfm and a low pressure of less than about 10 psig, and further including power supply circuitry providing a voltage of between about 5 and 10 KV to said electrode means.

27. The apparatus of claim 26, wherein said electrode means includes at least a first electrode, the total area of said electrode means being between about 0.25 and 1.3 square inches, said first electrode being radially spaced from said liquid outlet orifice by a distance of about 0.4 to 0.7 inch.

28. The apparatus of claim 12, wherein said electrode means includes at least two semicircular electrode elements spaced on diametrically opposite sides of said liquid outlet orifice and surrounding said liquid spray flow path in the region of said liquid outlet orifice.

29. The apparatus of claim 28, wherein said electrodes are generally cylindrical.

30. The apparatus of claim 28, wherein said electrodes are generally conical.

31. The apparatus of claim 28, further including air inlet means on said cap for introducing ambient air into said flow path.

32. The apparatus of claim 31, wherein said air inlet means comprises a plurality of openings extending through said cap.

33. The apparatus of claim 12, further including a target for receiving said liquid spray, said target being electrically nonconductive.

34. The apparatus of claim 33, further including a voltage source connected through said rotatable contact means to said electrode means, said voltage source providing a voltage having selected positive and negative polarities to provide negtaive and positive charges, respectively, on said liquid spray.

35. The apparatus of claim 34, wherein said voltage is cycled between said positive and negative polarities to alternatively provide positive and negative charges on said liquid spray.

36. An air cap rotatably mountable on automatic and hand-held spray guns, comprising:

a cap body portion having a front face, a rear face, and a circumferential outer surface therebetween;

an axial opening extending through said cap body portion from said rear face to said front face and terminating at said front face in a central spray outlet orifice, said axial opening being adapted to receive a spray gun nozzle for directing liquid to be sprayed through said spray orifice and further adapted to direct atomizing air through said orifice;

at least one curved electrode support on said front face and extending forwardly of said orifice, said electrode support having an inner surface spaced radially from said axial opening;

electrode means on said electrode support inner surface;

a rotatable connector having a first component on said cap body portion for engaging a corresponding second rotatable connector component on a spray gun for providing a rotatable electrical connection between a power supply and said cap body; and means electrically connecting said first component to said electrode for supplying a charging voltage to said electrode, whereby charges are produced on liquid directed through said spray orifice.

37. The air cap of claim 36, wherein said rotatable connector first component is a spring contact secured to said air cap and said second component is an annular surface on a spray gun.

38. The air cap of claim 36, wherein said rotatable connector first component is an annular surface on said air cap, and said rotatable connector second component is a spring contact secured to a spray gun.

39. The air cap of claim 36, wherein said at least one electrode support includes plural curved electrode supports spaced around and coaxial with said spray orifice, each said electrode support carrying at least one corresponding electrode.

40. The air cap of claim 39, wherein each of said plural electrode supports is spaced apart from a next adjacent electrode to produce an ambient air inlet.

41. The air cap of claim 39, further including a plurality of air inlets extending through said electrode supports.

42. The air cap of claim 39, further including a resistance electrically connected between said rotatable connector first component and each of said electrodes.

* * * * *

UNITED STATES PATENT AND TRADEMARK OFFICE

CERTIFICATE OF CORRECTION

PATENT NO. : 5,409,162

DATED : April 25, 1995

INVENTOR(S) : SICKLES, James E.

It is certified that error appears in the above-indentified patent and that said Letters Patent is hereby corrected as shown below:

Column 19,

Claim 3, line 2, cancel "spray".

line 3, after "patterned" insert --spray--.

Claim 4, line 3, cancel "electrodes".

Signed and Sealed this

Nineteenth Day of September, 1995

*Attest:*

*Attesting Officer*

Bruce Lehman

BRUCE LEHMAN

*Commissioner of Patents and Trademarks*